United States Patent [19]

Zarlengo

[11] 4,178,644

[45] Dec. 18, 1979

[54] WATER SAVING DEVICE FOR TOILET

[76] Inventor: Dominic A. Zarlengo, 3025 W. Scott Pl., Denver, Colo. 80211

[21] Appl. No.: 926,631

[22] Filed: Jul. 21, 1978

[51] Int. Cl.[2] ..... E03D 1/00; E03D 11/02; E03D 11/18

[52] U.S. Cl. ..... 4/426; 4/415; 4/421; 137/527.8

[58] Field of Search ..... 4/426, 421, 427, 395, 4/415, 326, 1; 137/403, 386, 395, 527.8

[56] References Cited

U.S. PATENT DOCUMENTS

| | | | |
|---|---|---|---|
| 763,561 | 6/1904 | Hooper | 4/426 |
| 1,157,989 | 10/1915 | Leonard | 4/426 |
| 1,654,832 | 1/1928 | Pohl | 4/426 |
| 2,694,358 | 11/1954 | Taylor | 137/527.8 X |
| 2,797,418 | 7/1957 | Reed | 4/395 |
| 2,825,506 | 3/1958 | Steinen | 137/527.8 X |
| 2,882,923 | 4/1959 | Smolensky | 137/527.8 X |
| 3,023,424 | 3/1962 | Litvin | 137/527.8 X |
| 3,809,119 | 5/1974 | Cava | 137/527.8 |
| 3,877,082 | 4/1975 | Wilhelm | 4/326 |
| 4,039,004 | 8/1977 | Luthy | 137/527.8 X |

*Primary Examiner*—Henry K. Artis
*Attorney, Agent, or Firm*—Gary M. Polumbus

[57] ABSTRACT

The quantity of fluid utilized in flushing a conventional closet-type toilet bowl is reduced by a water saving device. The water saving device is adapted to be positioned within the trap of the toilet, and includes a supporting frame with a movable gate operatively connected therewith to open and close the fluid flow passage through the trap to the sewer access opening. After the toilet flushing operation is effected, the gate remains in a closed position until the level of fluid in the toilet bowl reaches a predetermined level, at which time the gate opens to allow the fluid to flow into the sewer access opening by a natural siphoning action. After the flow of fluid through the trap diminishes, the gate returns to a closed position. As a result, the needless flow of fluid from the toilet bowl prior to the time the natural siphoning occurs is eliminated and a water savings is effected.

13 Claims, 6 Drawing Figures

WATER SAVING DEVICE FOR TOILET

BACKGROUND OF THE INVENTION

1. Field of the Invention

This invention relates to the savings of water, and more particularly, to an apparatus for saving water which is used in conjunction with a conventional closet-type toilet. The invention is of particular utility when it is recognized that a considerable amount of water is required to flush the common water closet-type toilet and that our supply of natural resources, particularly water, is diminishing as a result of unnecessary and other uses of these resources.

2. Brief Description of Prior Art

Methods and apparatus for saving water and used in conjunction with toilets are known in the prior art. Attempts have been made to reduce the amount of water used in flushing a toilet by employing timing means for actuating various water control valves associated with the toilet, introducing openings in the toilet trap walls to permit the bypass of water from the trap to the sewer access opening and thereby reduce the amount of water normally used, and establishing alternate water levels in the toilet water closet for purposes of flushing depending upon the volume of flushing fluids required. Many of these prior art devices are relatively complex in nature and are unsuitable for adaptation to a conventional pre-existing water closet-type toilet. Other of the prior art arrangements require relatively complex mechanical or electrical operating devices to achieve the water savings. In addition, many other disadvantages of prior art water saving devices for use in conjunction with toilets are known, and limited solutions to some of these disadvantages and problems may have occurred. However, the other limitations and disadvantages of prior art may be more readily apparent and appreciated in light of the improvements and teachings of the present invention.

SUMMARY OF THE INVENTION

The general objective of this invention is to provide a new and improved water saving device and method for use with a toilet. Other objects of the invention are to reduce the amount of water used in flushing the toilet and to elminate the flow of water from the toilet bowl during the pre-siphon phase of natural toilet operation. A further object of the invention is to provide a water saving device which is easily adaptable to conventional pre-existing toilets. A further objective of this invention is to provide a relatively convenient and inexpensive approach to saving water without reducing the effectiveness of the flush from a conventional toilet.

According to its objectives and general aspects, the water saving device of the toilet generally comprises a supporting frame adapted to be placed in a trap of a toilet, and a movable gate attached to the frame, preferably by a living hinge. Retaining means cooperatively functions with the frame and gate to hold the gate closed until the level of fluid in the toilet bowl reaches a predetermined level in the bowl. Thereafter, the retaining means releases the gate to allow the flow of fluid from the bowl through the trap and into a sewer access opening, thus effecting a completed flush operation for the toilet. When in the closed position, the gate functions as a dam preventing the passage of fluid through the trap. The supporting frame may be advantageously formed of material adapted to securely retain it within the trap of a conventional toilet. According to the method of the invention, the gate is opened in response to the fluid pressure created by the level of fluid in the bowl reaching the predetermined level, thereby eliminating the needless flow of water through the trap during the pre-siphon stage which occurs prior to the time that the natural siphoning action occurs.

A more complete understanding of the invention and its manner of achieving the objectives can be obtained from the following description of a presently preferred embodiment of the invention taken in conjunction with a drawing consisting of a number of figures, and from the appended claims.

DESCRIPTION OF PREFERRED EMBODIMENT

Figure 1:
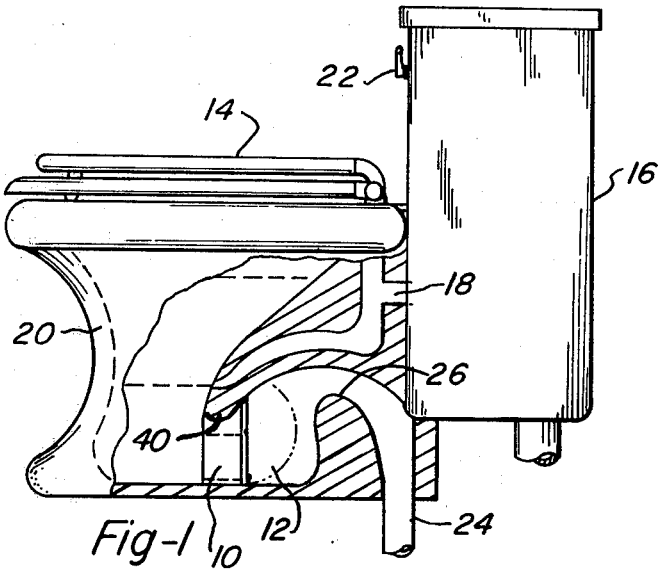
FIG. 1 is a side elevational view of a conventional water closet-type toilet with a certain portion broken out for clarity and illustrating therein the placement of a water savings device according to the present invention.

A water savings device 10 is adapted to be placed within the trap 12 of a conventional water closet-type toilet 14. As is conventional for water closet-type toilets 14, the toilet includes a water closet 16 containing a reservoir of fluid which is selectively conducted through a channel 18 into a bowl 20 of the toilet 14. A flush handle 22 operatively controls the flow of fluid through a conventional valve into the bowl in a conventional manner. As the fluid is admitted to the bowl 20, the level of fluid rises within the bowl to effect flushing of the toilet.

In conventional prior art toilets, not employing the water savings device 10, the level of fluid within the bowl 20 raises until the trap 12 is completely filled with fluid. Once filled with fluid, the trap acts as a siphon for completely removing all of the contents from the bowl 20 and passing them into a sewer access opening 24. Until such time as the trap 12 is completely filled with fluid after flushing, fluid in the bowl 20 drains into the sewer access opening 24 over the trap hump 26. The natural siphon is established as a result of the fluid from the closet 16 entering the bowl 20 more rapidly than it escapes over the trap hump 26. In this manner, the trap 12 is completely filled with fluid to effect the natural siphoning.

Figure 2:
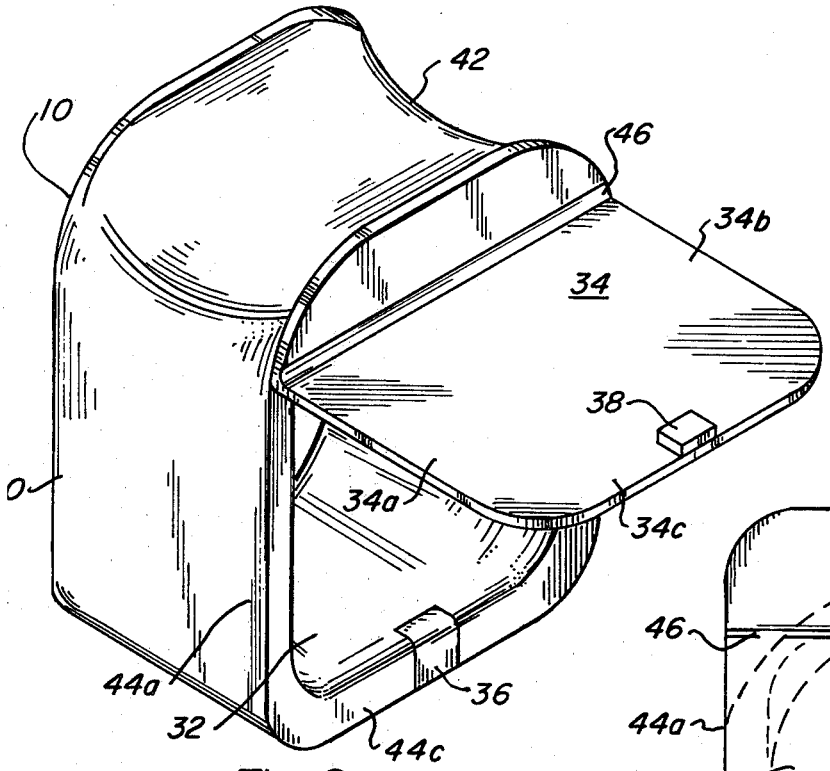
FIG. 2 is a perspective view of the water savings device illustrated in FIG. 1.
Figure 3:
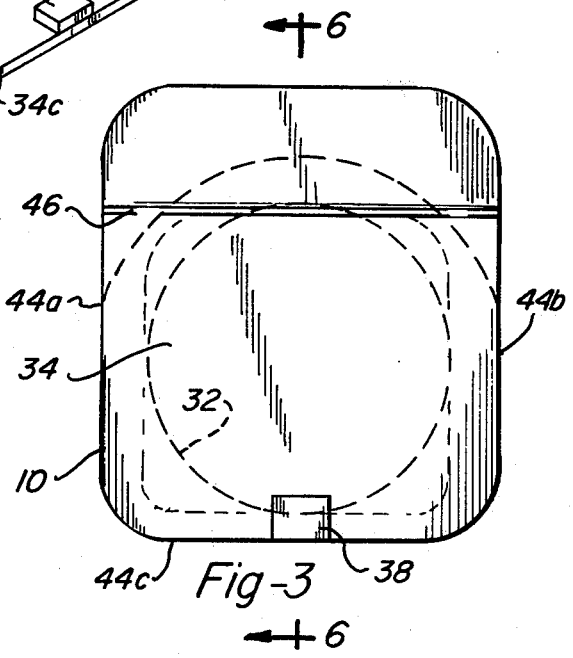
FIG. 3 is a front elevational view of the water savings device of FIG. 2.
Figure 4:
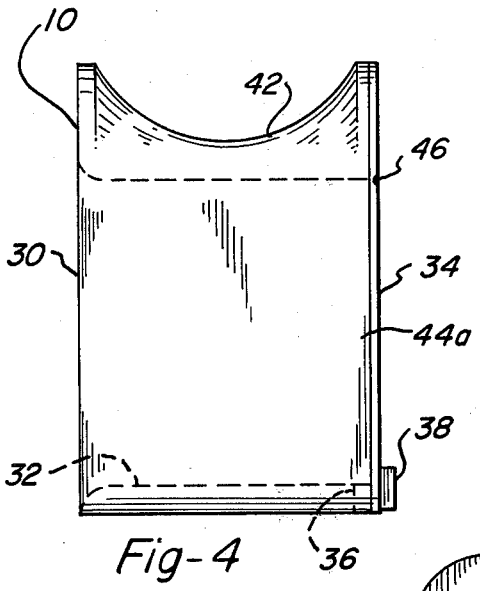
FIG. 4 is a side elevational view of the water savings device of FIG. 2.
Figure 5:
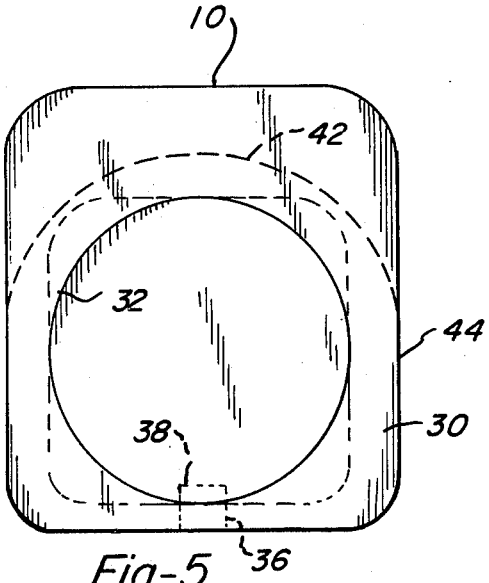
FIG. 5 is a rear elevational view of the water savings device of FIG. 2, viewed from the opposite side as that shown in FIG. 3.
Figure 6:
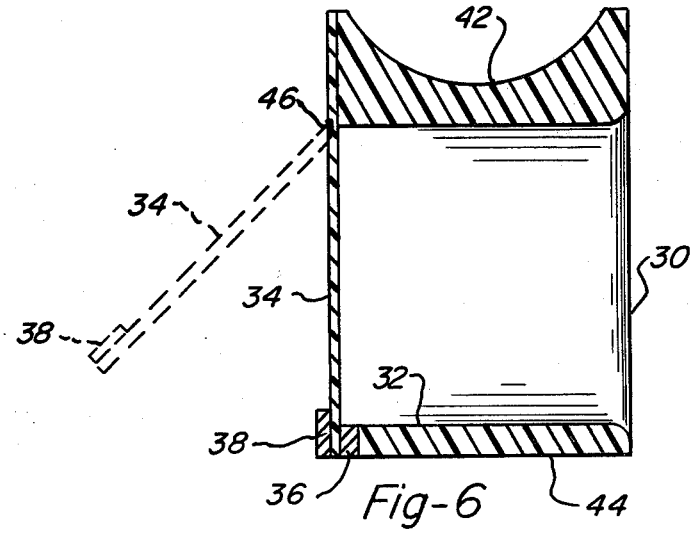
FIG. 6 is a vertical section view taken substantially in the plane of line 6—6 of FIG. 3.

Referring now to FIG. 2, the water savings device 10 comprises a supporting frame 30 made preferably of semi-flexible plastic material which is adapted to be positioned within the trap of the toilet. The supporting frame 30 includes an opening 32 formed therethrough, and a gate 34 affixed to the supporting frame to open and close the opening 32 in accordance with the position of the gate. A retaining means, preferably in the form of a magnet 36 and metallic attraction piece 38 are cooperatively positioned on the supporting frame and gate to retain the gate in a closed position and to allow opening of the gate under conditions of operation of the device 10, to be described subsequently.

The supporting frame 30, also shown in FIGS. 3 through 6, has an outer configuration adaptable to receive and to generally correspond with the contour of the trap opening at the trap protruberance 40 found at the junction of the bowl 20 and the trap 12. The top portion 42 of the peripheral edge of the supporting frame 30 is U-shaped for receiving the contour of the trap protruberance 40 when the supporting frame 30 is properly positioned in the trap opening. The peripheral edges of the supporting frame 30 closely adjoin and conform with the contour of the trap opening at the trap protruberance 40, when the supporting frame is properly positioned and preferably form a seal at the point of contact with the walls of the trap opening.

The walls 44 of the supporting frame 30 are of sufficient thickness as to maintain the supporting frame 30 firmly within the trap opening once it has been placed in its proper position. At the same time, the dimensions of the walls 44 permit the supporting frame 30 to be semi-flexible for insertion into and removal from the trap opening.

The supporting frame 30 includes an opening 32 of a size sufficient to allow the passage of waste material through the trap 12 without blocking or otherwise hindering passage of such material. Further, the supporting frame 30 includes a retaining means 36 preferably in the form of a magnet located on the bottom wall 44*c* thereof (vertically opposite to the U-shaped portion 42) at a point equally distant from the outermost transverse edges of the walls 44*a* and 44*b*. The retaining means is affixed to the wall of the supporting frame 30 by adhesive or is directly formed thereto.

The gate 34 is made of a semi-rigid material and is formed to the supporting frame 30 by a living hinge 46 transversely and horizontally positioned immediately above and without restricting the opening 32 of the supporting frame 30 on the opposite side of the supporting frame 30 from that which faces the bowl 20 when placed in the trap. The outer edges 34*a*, 34*b* and 34*c* of the gate 34 correspond to and are substantially identical with the outer configuration of the supporting frame 30. The gate 34 includes a retaining means 38, preferably in the form of a magnet or metallic attraction piece, located on the bottom edge 34*c* thereof at a point equally distant from the side edges 34*a* and 34*b* of said gate. The retaining means 38 is positioned to contact the retaining means 36 positioned on the supporting frame 30 when the gate is in a closed position. The retaining means operatively holds the gate 34 to the supporting frame 30, during certain conditions of operation described below.

During the flushing operation of a water closet-type toilet employing the water saving device 10, passage of fluid within the bowl is initially blocked as a result of the gate 34 being in a closed position due to the magnetic force created by the retaining means. As a result, the height of fluid within the bowl raises from its normal level A to the predetermined level B as shown in FIG. 1. Upon the fluid reaching the predetermined level B, the force on the gate 34 created by the pressure of fluid at that level, exceeds and overcomes the magnetic force created by the retaining means and the gate 34 opens allowing passage of material through the trap. Upon passage of substantially all of the contents and fluid of the bowl 20 through opening 32 of the water saving device 10, gravity allows the gate 34 to fall towards the supporting frame 30 and, upon reaching the effective range of the magnetic force created by the retaining means, the gate 34 returns to a closed position directly in contact with the supporting frame 30.

It should be apparent that use of this invention in a water closet-type toilet results in the savings of water by eliminating the pre-siphon phase that takes place during the flushing operation of a conventional water closet-type toilet which does not utilize this invention as can be seen by the brief comparison below.

When the flush handle 22 is activated in a water closet-type toilet, which does not utilize this invention, water is released from the water-closet 16 and conducted through a channel 18 into the bowl 20. To establish the siphon action at the trap 12 necessary to effect flushing of the toilet, water in the bowl 20 must rise from level A to level B. To reach level B, water must flow into the bowl 20 at a rate greater than the rate at which water flows out of the bowl 20 at the trap 12 during the time the water level is rising to level B. When the water in the bowl 20 rises to level B, the siphon action at the trap 12 is effectuated and the source from the water-closet 16 is cut off completing the flushing action of the toilet.

The amount of water which flows out of the bowl 20 through the trap 12 during the time the level of water in the bowl 20 rises from level A to level B can be saved by utilizing the invention. This water saving occurs as a result of the gate 34 remaining in a closed position which prevents the flow of water through the trap 12 during the time the level of water in the bowl rises from level A to level B. When the level of water in the bowl rises to level B the level of water in the bowl 20 is sufficient to establish the siphon action at the trap 12 and the pressure of water at that level is sufficient to cause the gate 34 to open allowing the flow of water through the trap 12.

The device 10 of the invention is suitable for use in conventional pre-existing water closet-type toilets without the need for modification or alteration of the toilet. It is completely self-contained within the trap opening and does not require external mechanical or electrical means for purposes of operation. Further, in view of a limited number of moving parts, it is relatively trouble free from a mechanical operation standpoint.

Although the present invention has been described with a certain degreee of particularity, it is understood that the present disclosure has been made by way of example and that changes in details of structure may be made without departing from the spirit of the invention.

What is claimed is:

1. Apparatus for reducing the quantity of fluid utilized in flushing a closet type toilet bowl wherein the fluid flows through a trap which defines a passage connecting the bowl to a sewer access opening, said apparatus comprising:

(a) a supporting frame adapted to be positioned in the trap, said frame being designed to conform with the particular contours of the trap so as to remain in position within the trap;

(b) a gate affixed to the supporting frame, (c) means for retaining the gate in closed position until a predetermined level of fluid is reached in the bowl and for releasing the gate to allow the flow of fluid from the bowl through the trap upon the fluid attaining the predetermined level.

2. Apparatus as recited in claim 1 wherein said supporting frame is semi-flexible.

3. Apparatus as recited in claim 2 wherein said supporting frame is adapted to fit tightly within the trap.

4. Apparatus as recited in claim 1 wherein said gate is semi-rigid.

5. Apparatus as recited in claim 4 wherein said gate is formed to the supporting frame.

6. Apparatus as recited in claim 5 wherein said gate is formed to the supporting frame by a living hinge.

7. Apparatus as recited in claim 1 wherein said retaining means is operatively connected between the supporting frame and the gate.

8. Apparatus as recited in claim 7 wherein said retaining means is positioned on the gate.

9. Apparatus as recited in claim 7 wherein said retaining means is essentially enclosed within the supporting frame.

10. Apparatus as recited in claim 7 wherein said retaining means is adapted to be completely contained within the trap.

11. Apparatus as recited in claim 7 wherein said retaining means is mechanically operable.

12. Apparatus as recited in claim 7 wherein said retaining means is magnetically operable.

13. Apparatus as recited in claim 12 wherein said means comprises a magnet.

* * * * *